United States Patent [19]

Schaffner

[11] Patent Number: 4,850,158

[45] Date of Patent: Jul. 25, 1989

[54] METHOD OF MAKING BUFFING WHEEL

[76] Inventor: William M. Schaffner, 711 Nordica Dr., Pittsburgh, Pa. 15237

[21] Appl. No.: 273,346

[22] Filed: Nov. 18, 1988

Related U.S. Application Data

[62] Division of Ser. No. 107,398, Oct. 9, 1987, Pat. No. 4,799,338.

[51] Int. Cl.[4] ..... B24D 9/08

[52] U.S. Cl. ..... 51/334; 51/358; 51/376; 51/388; 29/432

[58] Field of Search ..... 51/334, 358, 376, 388, 51/394, 400, 403, 404, 206 NF; 15/207, 208, 209 R, 217, 230, 230.17; 29/432

[56] References Cited

U.S. PATENT DOCUMENTS 2,668,399 2/1954 Kingsbury ..... 15/230.17
3,451,093 6/1969 McAleer ..... 15/230.17

*Primary Examiner*—Frederick R. Schmidt

*Assistant Examiner*—Maurina Rachuba

*Attorney, Agent, or Firm*—Hymen Diamond

[57] ABSTRACT

A buffing wheel in which the strap of ductile metal encircles and abuts the circular body member from whose peripheral edges the teeth which engage the annulus of buffing fabric extend. Each pair of successive teeth defines between them an angle having a sharp apex at their junctions with the body member. In use, the buffing wheel is rotated at a high speed so that high centrifugal tensile force is transmitting through the teeth to their junctions with the body member. This force is concentrated at the apeces formed between successive teeth. The strap absorbs the concentrated stress, in part, preventing cracks in the body member from developing, but predominantly preventing cracks, even cracks which sever the body member, which do develop from spreading and causing catastrophic failure of the ring and an explosion of a buffing assembly including the ganged buffing wheels.

1 Claim, 3 Drawing Sheets

METHOD OF MAKING BUFFING WHEEL

REFERENCE TO RELATED APPLICATION

This application is a division of application Ser. No. 07/107,398 filed Oct. 9, 1987 for BUFFING WHEEL, now Pat. No. 4,799,338.

BACKGROUND OF THE INVENTION

This invention relates to finishing of objects of metal and other materials and it has particular relationship to buffing wheels and their operation while in use. A buffing wheel includes a ring of metal having claws from which an annulus of fabric material for buffing extends. The ring has teeth which engage the fabric annulus near its inner periphery. In use the buffing wheel is mounted on a drive shaft and is rotated in engagement with the object to be buffed. Common practice is to gang a number of buffing wheels on a shaft with their lateral surfaces abutting for the purpose of buffing large objects like car fenders and the like. The ganged buffing wheels are rotated at a high speed, typically 1750 revolutions per minute.

In the use of the buffing wheels constructed in accordance with the teachings of the prior art, instances in which buffing wheels explode in certain regions have been experienced. These explosions are hazardous to the personnel carrying out the buffing operations, or who happen to be present when the operations are automatic. The explosions also result in economic loss since once an explosion occurs, it is necessary that the buffing line be shut down and the wheels replaced. This loss is particularly high in operations involving a long line of ganged buffing wheels. In this case, the whole line must be replaced.

It is an object of this invention to overcome the above-described drawbacks of prior art buffing wheels and to provide a method of making a buffing wheel in whose use the explosions shall be precluded.

SUMMARY OF THE INVENTION

Prior to this invention, a major obstacle to the suppression or elimination of the explosions has been lack of knowledge as to the cause of the explosions. This invention has at its roots the discovery that the cause of the explosions resided in the structure of the ring to which the buffing fabric is secured and to the reaction of the ring to the high centrifugal force which is impressed on the ring in use. The ring is formed from a blank stamped out of a sheet by a die in a press. The blank includes a central strip-like portion from whose edges the projections which form the teeth extend. The blank is bent into a ring and welded at overlapping edges. In this ring, the teeth extend from a circular body member. The annulus of buffing fabric with the teeth engaging near its inner periphery is then formed generally in the manner described in Schaffner pat. No. 2,805,530.

It has been realized that in forming the blank, an angular notch having a sharp apex is formed between each successive pair of projections which form the teeth. In use, the fabric on being rotated at a high speed exerts a high tensile force on the teeth. The stress produced by this force is concentrated at the sharp apeces in the notches between the teeth causing cracks to develop at these apeces and to spread or progress as the use of the wheels continues. Ultimately, catastrophic failure occurs and there is an explosion.

Another factor which exacerbates the development and spreading of the cracks is the composition of the ring. The ring is composed of a material, typically a carbon steel, which has relatively low ductility and it lends itself readily to development and spreading of the cracks and to the resulting catastrophic failure.

A contributing factor to the failure of the wheel is metal fatigue. The fatigue results from recurrent flexing developed in the ring between the regions where the drive shaft is connected to the wheel through spokes which engage the inner surface of the body member. As the wheel rotates, the centrifugal force deflects the regions of the ring between the spokes outwardly. This deflection is counteracted by the pressure exerted by the work on the buffing fabric as the wheel rotates past the region where the work is engaged. The regions between the spokes are in use flexed inwardly in the regions of the work and outwardly in other regions and this results in metal fatigue.

The explosion is caused by the progression of the cracks in one or more of the ganged buffing wheels to a state at which one or more of the rings is ruptured. The ganged wheels are secured together in a tight unit by a nut at the remote end of the spoked shaft which is threaded onto the end of the shaft and tightened. Once one or more rings are broken, the pressure exerted by the nut causes the array of ganged buffing wheels to collapse and this manifested as an explosion.

In accordance with this invention there is provided a method of making a buffing wheel in whose practice there is stamped from a metal sheet a blank in the form of a strip-like member from at least one of whose edges teeth extend. The blank is formed into a ring with the strip-like member constituting a body member of transverse, circular cross-section from which the teeth extend coaxially. A strap is secured to the outer surface of the body member. An annulus of fabric material is then secured to the ring by causing the teeth to engage the radially inner surface of the annulus. The width of the strap is less by only a small magnitude than the width of the body member so that it is spaced only a short distance from the apeces. The strap tends to prevent the formation of cracks at the roots of the teeth in the ring. To the extent that cracks develop in the ring, the strap helps to prevent the spreading of the cracks and the resulting catastrophic failure and explosion. In fact, it has been found that in situations in which a crack severs the body member of the ring entirely, the strap confines the cracked area and prevents the ring from separating at the severed seam, i.e., the strap maintains the lips which bound the seam in the body member substantially in abutment. Catastrophic failure of a buffing wheel in this event is thus also avoided.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

Figure 1:
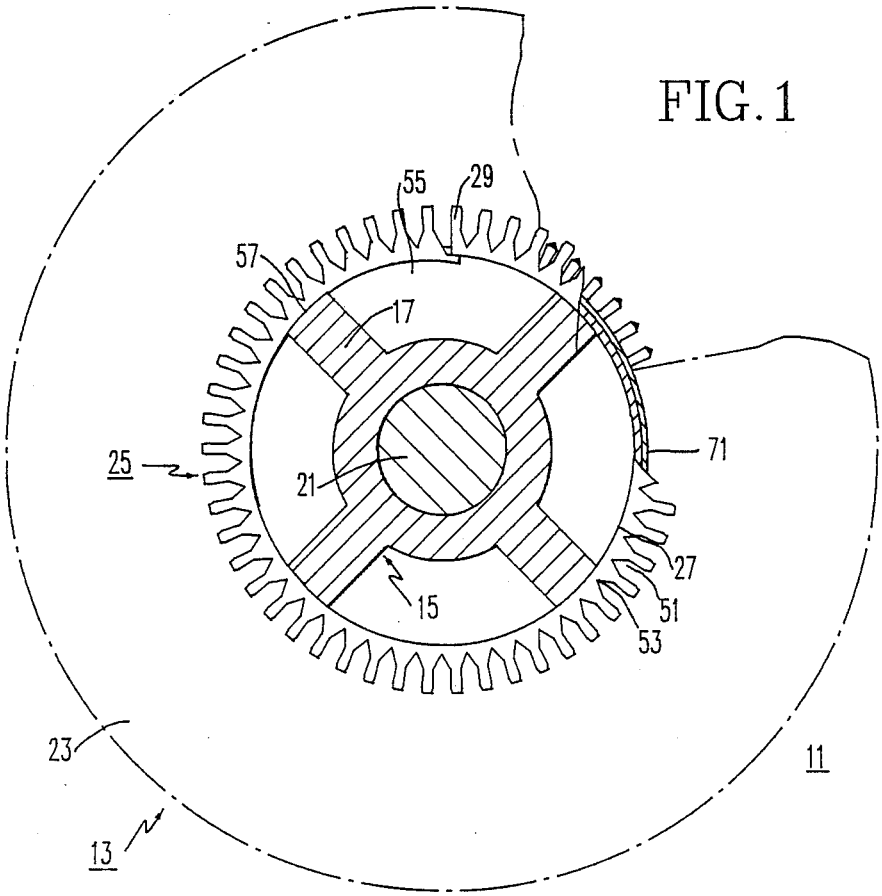
FIG. 1 is a view in end elevation, with parts broken away to show the internal structure, of a buffing wheel made in the practice of this invention.
Figure 3:
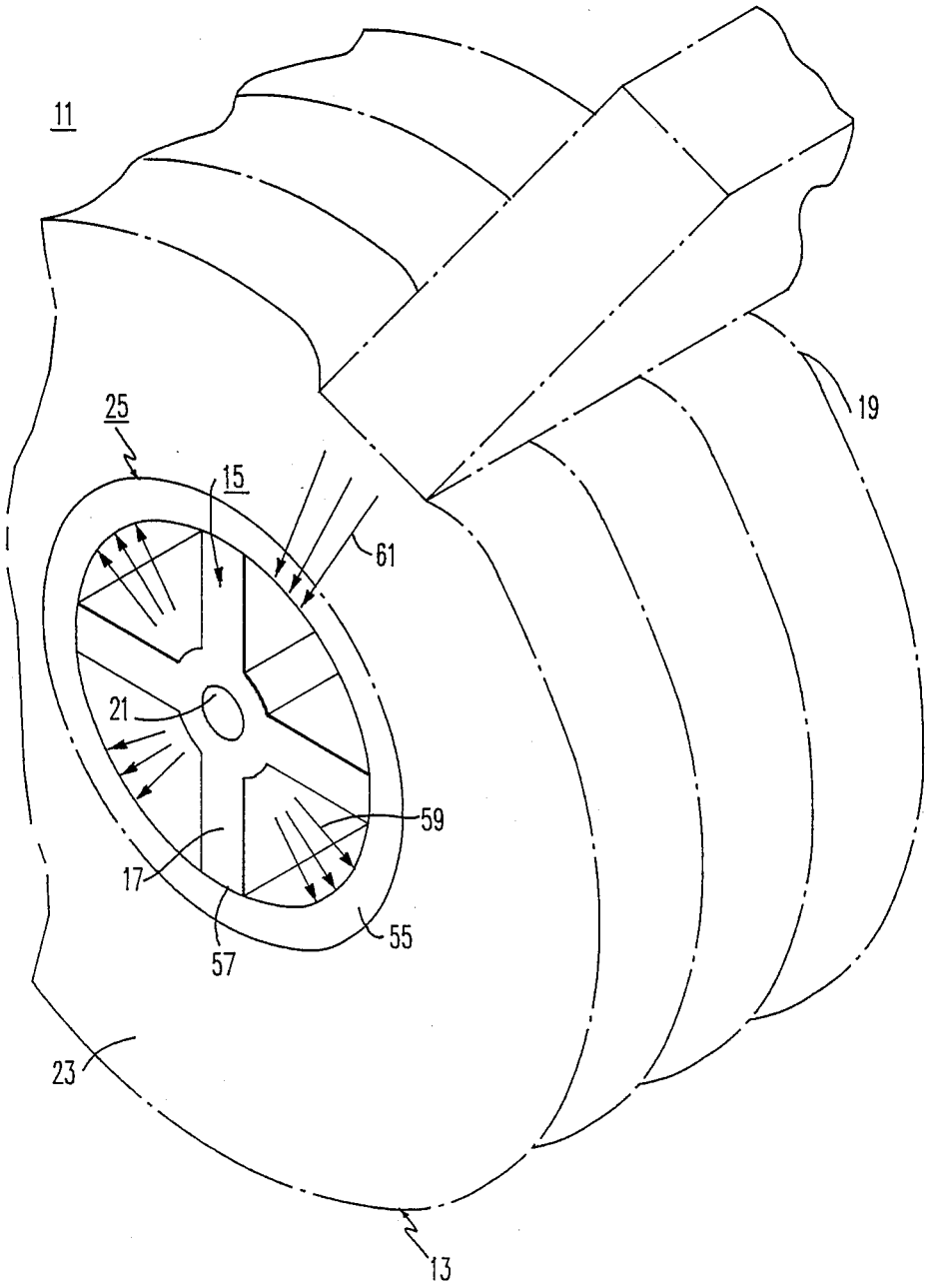
Figure 4:
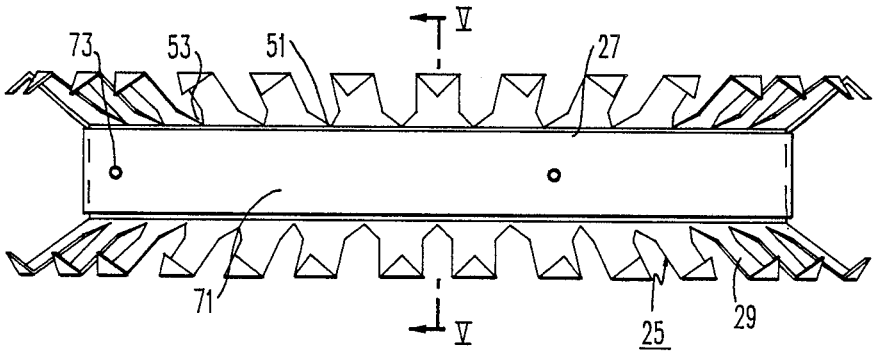
Figure 5:
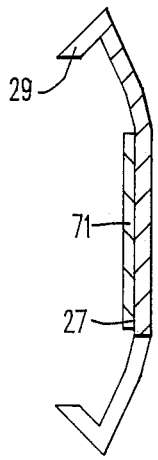

FIG.. 2 is a plan view showing the manner in which the blanks for the ring of the buffing wheel shown in FIG. 1 are stamped out;

FIG. 3 is a view in isometric of a buffing assembly including ganged buffing wheels showing the manner in which stresses are developed in the buffing wheel;

FIG. 4 is a view in side elevation of the ring assembly of the buffing wheel made in the practice of the invention; and FIG. 5 is a view in section taken along line V—V of FIG. 4.

DETAILED DESCRIPTION OF EMBODIMENT

The apparatus shown in the drawings includes a buffing assembly 11 including buffing wheels 13 made in the practice of this invention. As shown in FIG. 3, the buffing assembly 11 includes a plurality of buffing wheels 13 ganged on a shaft 15 having spokes 17 through which the assembly is driven in buffing work 19 (FIG. 3). The spokes 17 radiate from a central member 21 which extends outwardly of the spokes 17 at each end. At the remote outer end of the assembly 11, the member 21 is threaded (not shown). A nut (not shown) is turned onto the thread and tightened so that the ganged wheels 13 are under substantial compression.

The buffing wheel 13 includes an annulus 23 of fabric material for buffing and a ring 25. The ring 25 is of circular shape. It includes a central circular body member 27 (FIG. 5) from whose peripheral edges teeth 29 extend. The annulus 23 is secured to the ring by the teeth 29 which engage the annulus 23 near its inner periphery.

Figure 2:
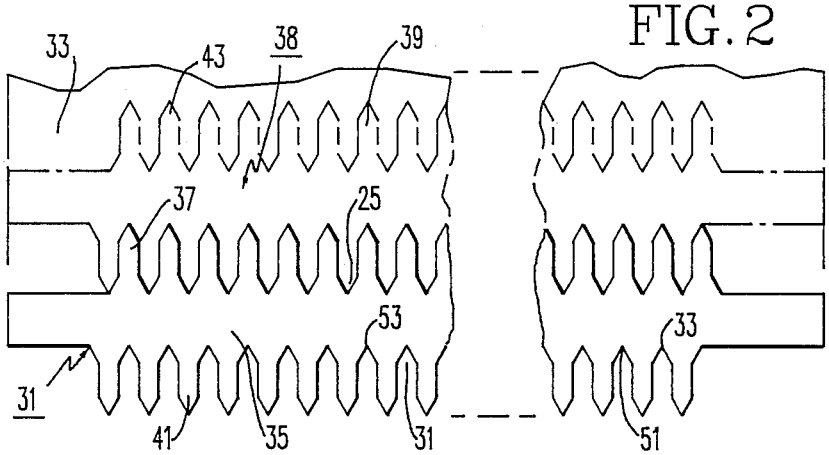

The ring 25 is formed from a blank 31 which is produced with a die in a press. The blank 31 is stamped out of a metallic sheet 33. Typically, the sheet 33 is No. 3 temper, one-fourth hard, carbon steel, 0.060-inch thick (16 gauge). The blank 31 has a strip-like base 35 from which projections 37 extend. The base 35 forms the circular body member 27 of the ring 25 and the projections 37 form the teeth. To minimize scrap, a plurality of blanks are stamped out of a sheet 33 as demonstrated by the blank 38 (FIG. 2) defined by broken lines. The projections 39 of blanks such as 38, which are stamped out contiguously to the blank 31, are formed of the metal which is removed between the projections 37 of the contiguous blank 31. Th projections 37 and 39 have triangular tips 41 and 43 with sharp apeces so that the corresponding teeth will engage the annulus 23 effectively. The metal which is removed between successive pairs of projections 37 of a blank such as 31 to form a projection 39 of a contiguous blank such as 38 creates a notch 51 which has a sharp tip 53 (identified between a successive pair of the lower array of projections 37 in the interest of clarity).

When the buffing wheel 13 is in use and the centrifugal force is impressed by the annulus 23 on the ring 25 through the teeth 29, the resulting stress is concentrated at the tips 53 and there is a tendency to produce cracks inwardly from the tips.

The tendency to crack is exacerbated by the phenomenon of metal fatigue as will now be described with reference to FIG. 3. The assembly 11 is driven by the shaft 15 at a high speed. The centrifugal force flexes the portions 55 of the rings 25 between the regions 57 where the rings are engaged by the spokes 17 outwardly as represented by the arrows 59. The work 19 engages the annulus 23 under substantial pressure. In the region of engagement of the work 19 and the annulus 23, the centrifugal force is counteracted by the force produced by the pressure of the work 19 as shown by the arrow 61. This force tends to flex the portion 55 inwardly. As the wheel is rotated, the quadrants 55 of the ring 25 are flexed outwardly and inwardly producing metal fatigue and causing the cracks in the ring to develop and progress until the ring is ruptured and catastrophic failure occurs.

In accordance with this invention, failure of the buffing wheel is precluded by encircling the outer surface of the body member 27 of the ring 25 with a strap 71. Typically, the strap is composed of steel binder; cold rolled carbon steel, with maximum anneal and medium ductility. Typical thickness of the strap 71 is .020-inch. The strap is dimensioned with its width so that its outer edges are near to the tips 53. In a typical situation, the circular body member 27 has a width of ½-inch and the strap has a width of ⅜-inch so that the edges of the strap are spaced 1/16-inch from the apeces 53. The strap is mounted in abutment with the outer surface of the body member and is secured to the body member by a minimal number of spot welds 73 (typically 3). In the practice of this invention, it has been found that catastrophic failures of buffing wheels in accordance with this invention and explosions have been eliminated because the strap 71 prevents cracks from developing in the body member 27 or confines the cracked area even if severance occurs. In typical wheels in accordance with this invention, the ring 25 has an inner diameter as measured to the inner surface of the central body member of 5, 7 or 9 inches and the buffing annulus has an inner diameter of 12 inches and an outer diameter of 22 inches.

In making a wheel in accordance with this invention, a blank 31 is stamped out and formed into a ring. Typically, the blank is bent into a circular shape with the ends overlapping and then the overlapping ends are welded. The resulting ring includes the central body member 27 with the projections 37 bent inwardly towards each other. The band 71 is then mounted in a jig on the outer surface of the body member 27 and secured to the body member by spot welds 73. The annulus of fabric material is then mounted on the ring and secured by the teeth 29 as taught by Schaffner 2,805,630, except that instead of being thrust into the ring by a wire (59 FIGS. 2 and 9 Schaffner), the sheets of fabric are thrust into the ring by an iris-like tool.

While practice of this invention has been disclosed herein, many modifications thereof are feasible. This invention is not to be restricted, except insofar as is necessitated by the spirit of the prior art.

I claim:

1. The method of making a buffing wheel including stamping from a metal sheet by means of a press and a die a blank including a strip-like member from whose edges projections extend, said projections being shaped to form teeth, forming said blank into a ring with the strip-like member constituting a circular body member from whose peripheral edges said projections extend as teeth, securing a strap to the outer surface of said body member with the inner surface of said strap engaging the outer surface of said body member, and securing an annulus of fabric material for buffing to said ring by causing said teeth to engage said fabric near the inner periphery of said annulus.

* * * * *